US010738256B1

(12) United States Patent
Franke

(10) Patent No.: US 10,738,256 B1
(45) Date of Patent: Aug. 11, 2020

(54) FUEL ADDITIVE SYSTEMS, COMPOSITIONS, AND METHODS

(71) Applicant: Tersol LLC, Incline Village, NV (US)

(72) Inventor: Hans G. Franke, Incline Village, NV (US)

(73) Assignee: TerSol, LLC, Chagrin Falls, OH (US)

( * ) Notice: Subject to any disclaimer, the term of this patent is extended or adjusted under 35 U.S.C. 154(b) by 167 days.

(21) Appl. No.: 15/853,539

(22) Filed: Dec. 22, 2017

(51) Int. Cl.
*C10L 10/02* (2006.01)
*C10L 1/18* (2006.01)
(Continued)

(52) U.S. Cl.
CPC ..... *C10L 10/02* (2013.01); *C10L 1/18* (2013.01); *C10L 1/1822* (2013.01);
(Continued)

(58) Field of Classification Search
CPC .... C10L 10/02; C10L 1/18; C10L 2200/0476; C10L 1/1822; C10L 1/1852; C10L 2270/02
See application file for complete search history.

(56) References Cited

U.S. PATENT DOCUMENTS 4,468,233 A * 8/1984 Bruderreck ..... C10L 1/023 44/446
4,818,250 A * 4/1989 Whitworth ..... C10L 1/06 44/430
(Continued)

FOREIGN PATENT DOCUMENTS

EP 2072608 * 6/2009
JP 56-016593 A 2/1981
(Continued)

OTHER PUBLICATIONS

Arudi, et al., "Purification of oleic acid and linoleic acid," Journal of Lipid Research, vol. 24, 1983.
(Continued)

*Primary Examiner* — Cephia D Toomer
(74) *Attorney, Agent, or Firm* — Birkenmeier Law, PLLC

(57) ABSTRACT

In some embodiments, the present disclosure relates to fuel additives and methods for reducing a NOx produced by combusting a liquid fuel, the method comprising combining the liquid fuel and an additive, forming an enriched combustible fuel composition, wherein the additive comprises at least one compound according to Formula I, wherein $R_1$ is selected from the group consisting of HO, EtO, PrO, BuO, i-PrO, and t-BuO; $R_2$ is selected from the group consisting of $(C{=}O)R_3$, $C_{1-18}$ alkyl, $C_{1-6}$ alkyl alcohol, $C_{2-18}$ monounsaturated alkyl, and $C_{4-18}$ polyunsaturated alkyl; and $R_3$ is selected from the group consisting of $C_{1-18}$ alkyl, $C_{1-6}$ alkyl alcohol, $C_{2-18}$ monounsaturated alkyl, and $C_{4-18}$ polyunsaturated alkyl, wherein each stereoisomer is selected from the group consisting of E, Z, R, and S, and wherein combusting the enriched combustible fuel would produce an exhaust gas comprising from about 2% to about 98% of the $NO_x$ produced by combusting the liquid fuel alone.

38 Claims, 4 Drawing Sheets

(51) Int. Cl.
*C10L 1/182* (2006.01)
*C10L 1/185* (2006.01)

(52) U.S. Cl.
CPC ..... *C10L 1/1852* (2013.01); *C10L 2200/0476* (2013.01); *C10L 2270/02* (2013.01)

(56) References Cited

U.S. PATENT DOCUMENTS

| | | | | |
|---|---|---|---|---|
| 6,023,928 | A | 2/2000 | Peter-Hoblyn et al. | |
| 6,051,040 | A | 4/2000 | Peter-Hoblyn | |
| 6,063,350 | A | 5/2000 | Tarabulski et al. | |
| 6,238,446 | B1 * | 5/2001 | Henderson | C10L 1/02 44/359 |
| 6,279,603 | B1 | 6/2001 | Czarnik et al. | |
| 7,063,729 | B2 | 6/2006 | Valentine et al. | |
| 7,216,681 | B2 | 5/2007 | Valentine et al. | |
| 7,285,140 | B2 | 10/2007 | Valentine | |
| 7,470,407 | B2 | 12/2008 | Toyoda | |
| 7,743,737 | B2 | 6/2010 | Valentine et al. | |
| 7,964,154 | B2 | 6/2011 | Makkee et al. | |
| 8,323,601 | B2 | 12/2012 | Justice et al. | |
| 8,858,903 | B2 | 10/2014 | Nazarpoor | |
| 8,969,228 | B2 | 3/2015 | Nazarpoor | |
| 9,011,784 | B2 | 4/2015 | Golden et al. | |
| 9,012,353 | B2 | 4/2015 | Golden et al. | |
| 9,073,011 | B2 | 7/2015 | Hatfield | |
| 9,216,382 | B2 | 12/2015 | Nazarpoor | |
| 9,216,383 | B2 | 12/2015 | Nazarpoor | |
| 9,216,408 | B2 | 12/2015 | Nazarpoor | |
| 9,216,410 | B2 | 12/2015 | Hatfield | |
| 9,227,177 | B2 | 1/2016 | Nazarpoor | |
| 9,259,716 | B2 | 2/2016 | Nazarpoor | |
| 9,433,930 | B2 | 9/2016 | Nazarpoor | |
| 9,468,912 | B2 | 10/2016 | Nazarpoor et al. | |
| 9,475,004 | B2 | 10/2016 | Hatfield et al. | |
| 9,475,005 | B2 | 10/2016 | Hatfield et al. | |
| 9,476,005 | B1 * | 10/2016 | Schuetzle | C10L 10/08 |
| 9,498,767 | B2 | 11/2016 | Nazarpoor | |
| 9,511,353 | B2 | 12/2016 | Nazarpoor | |
| 9,511,355 | B2 | 12/2016 | Nazarpoor et al. | |
| 9,511,358 | B2 | 12/2016 | Nazarpoor et al. | |
| 9,517,449 | B2 | 12/2016 | Nazarpoor et al. | |
| 9,579,604 | B2 | 2/2017 | Hatfield et al. | |
| 9,604,175 | B2 | 3/2017 | Hatfield et al. | |
| 9,610,570 | B2 | 4/2017 | Nazarpoor et al. | |
| 9,700,841 | B2 | 7/2017 | Golden | |
| 9,731,279 | B2 | 8/2017 | Nazarpoor et al. | |
| 9,771,534 | B2 | 9/2017 | Sprague et al. | |
| 2003/0051393 | A1 * | 3/2003 | Stickney | C10L 1/02 44/385 |
| 2004/0118033 | A1 * | 6/2004 | Wilkes | C10L 1/14 44/385 |
| 2016/0312730 | A1 | 10/2016 | Launois et al. | |
| 2016/0361710 | A1 | 12/2016 | Nazarpoor et al. | |
| 2016/0361711 | A1 | 12/2016 | Nazarpoor et al. | |
| 2017/0095794 | A1 | 4/2017 | Nazarpoor et al. | |
| 2017/0095800 | A1 | 4/2017 | Nazarfoor et al. | |
| 2019/0309232 | A1 * | 10/2019 | Dupre | C10L 1/04 |

FOREIGN PATENT DOCUMENTS

| | | | |
|---|---|---|---|
| KR | 10-2013-0125880 | A | 11/2013 |
| KR | 1020120049460 | * | 11/2013 |

OTHER PUBLICATIONS

Gibian et al., "Product Yield in Oxygenation of Linoleate by Soybean Lipoxygenase: The Value of the Molar Extinction Coefficient in the Spectrophotometric Assay," Analytical Biochemistry, 163, 343-349 (1987).

International Search Report and Written Opinion dated Apr. 15, 2019 for related International Patent Application No. PCT/US2018/067034, 7 pages.

Kolakoti, A. et al., "Effect of Fatty Acid Composition on the Performance and Emission Characteristics of an IDI Supercharged Engine Using Neat Palm Biodiesel and Coconut Biodiesel as an Additive," Biofuels, 2017 (E-pub.: Jun. 6, 2017] pp. 1-15.

Lapuerta. M. et al., "The Suitability of Fatty Acid Methyl Esters (FAME) as Blending Agents in Jet A-1," In: Biofuels for Aviation, Academic Press, 2016, pp. 47-84.

Pasae, Y., "The Effect of Blending Branched Fatty Acid Ester With Biodiesel Towards Physical Properties, Engine Performance and Exhaust Emission," Journal of Bioengineering and Applied Sciences, Sep. 2017, vol. 12, No. 17, pp. 5104-5108.

Yang et al., "Analysis of Soybean Oil from Ohio," JAOCS, vol. 67, No. 9, Sep. 1990.

* cited by examiner

FUEL ADDITIVE SYSTEMS, COMPOSITIONS, AND METHODS

FIELD OF THE DISCLOSURE

The present disclosure relates, in some embodiments, to fuel and fuel additive systems, compositions and methods.

BACKGROUND OF THE DISCLOSURE

Fuel consumption continues to grow notwithstanding volatility in global market prices and known and growing concerns related to environmental impact.

SUMMARY

Accordingly, a need has arisen for reducing emissions produced by combusting engine fuels by including fuel additives. The present disclosure relates to systems, compositions, and methods for reducing the expense and/or environmental impact of combustion engines. The present disclosure relates to a method for reducing a NOx produced by combusting a liquid fuel, the method comprising: combining the liquid fuel and an additive to form an enriched combustible fuel composition, wherein the liquid fuel may be selected from the group consisting of aliphatic hydrocarbons, gasoline, jet fuel, diesel, biodiesel, and combinations thereof, wherein the additive may comprise at least one compound according to Formula I: $R_1$-$R_2$ (I). $R_1$ may be selected from the group consisting of HO, EtO, PrO, BuO, i-PrO, and t-BuO; $R_2$ may be selected from the group consisting of (C═O)$R_3$, $C_{1-18}$ alkyl, $C_{1-6}$ alkyl alcohol, $C_{2-18}$ monounsaturated alkyl, and $C_{4-18}$ polyunsaturated alkyl; and $R_3$ may be selected from the group consisting of $C_{1-18}$ alkyl, $C_{1-6}$ alkyl alcohol, $C_{2-18}$ monounsaturated alkyl, and $C_{4-18}$ polyunsaturated alkyl. Each stereoisomer may be selected from the group consisting of E, Z, R, S, and a combination thereof. Combusting an enriched combustible fuel option would produce an exhaust gas may comprise from about 2% to about 98% of the $NO_x$ produced by combusting the liquid fuel alone.

A method of reducing a NOx produced by combusting a combustible fuel composition in a combustion engine comprising at least one combustion chamber and at least one exhaust port, the method may comprise: (a) contacting each combustion engine chamber with the combustible fuel composition, the combustible fuel composition may comprise: (i) a liquid fuel selected from the group consisting of aliphatic hydrocarbons, gasoline, jet fuel, diesel, biodiesel, and combinations thereof; and (ii) an additive may comprise at least one glycol having a structure according to Formula I: $R_1$-$R_2$ (I) wherein: $R_1$ may be selected from the group consisting of HO, EtO, PrO, BuO, i-PrO, and t-BuO; $R_2$ may be selected from the group consisting of (C═O)$R_3$, $C_{1-18}$ alkyl, $C_{1-6}$ alkyl alcohol, $C_{2-18}$ monounsaturated alkyl, and $C_{4-18}$ polyunsaturated alkyl; and $R_3$ may be selected from the group consisting of $C_{1-18}$ alkyl, $C_{1-6}$ alkyl alcohol, $C_{2-18}$ monounsaturated alkyl, and $C_{4-18}$ polyunsaturated alkyl. Each stereoisomer may be selected from the group consisting of E, Z, R, S, and a combination thereof; (b) combusting the combustible fuel composition to produce an exhaust gas; and (c) venting at least a portion of the exhaust gas. An exhaust gas may comprise at an exhaust port up from about 2% to about 98% of the $NO_x$ in a reference exhaust gas produced by combusting the same combustible fuel composition that lacks the additive.

According to some embodiments, a liquid fuel may comprise at least one of, a jet fuel, a diesel fuel, a gasoline, a naphtha, an ethanol, a coal tar, a liquefied petroleum gas, a compressed natural gas, and a butanol. A jet fuel may comprise at least one of, Avtur, aviation turbine fuel, Jet A, Jet A-1, Jet A-2, Jet A-3, Jet A-4, Jet A-5, Jet A-6, Jet A-7, Jet A-8, Jet B, Jet Propellant-4, Jet Propellant-5, Jet Propellant-7, and Jet Propellant-8. A concentration of an additive may be about 7% (w/v), by volume of an enriched combustible fuel. The method of claim 22, wherein the concentration of an additive may be about 14% (w/v), by volume of an enriched combustible fuel. A concentration of an additive may be about 21% (w/v), by volume of an enriched combustible fuel. A concentration of an additive may be about 28% (w/v), by volume of an enriched combustible fuel. An exhaust gas may comprise from about 2% to about 20% of a $NO_x$ produced by combusting a liquid fuel alone. An exhaust gas may further comprise from about 2% to about 10% of a $NO_x$ produced by combusting a liquid fuel alone.

In some embodiments, an exhaust gas may further comprise from about 2% to about 5% of a $NO_x$, produced by combusting a liquid fuel alone. An exhaust gas may further comprise from about 10% to about 50% of a carbon monoxide produced by combusting a liquid fuel alone. An exhaust gas may further comprise less than about 120 ppm of carbon monoxide. An exhaust gas may further comprise less than about 60 ppm of carbon monoxide. An exhaust gas may further comprise from about 0% to about 35% of a sulfur dioxide produced by combusting a liquid fuel alone. An exhaust gas may further comprise less than about 30 ppm sulfur dioxide. An exhaust gas may further comprise substantially no sulfur dioxide. An exhaust gas may further comprise less than about 1050 ppm $NO_x$. A temperature of an exhaust gas may be less than about 700° F. A temperature of an exhaust gas may be from about 85% to about 95% of a temperature produced by combusting a liquid fuel alone. An opacity of an exhaust gas may be less than about 0.05%. An opacity of an exhaust gas may be less than about 0.02%.

BRIEF DESCRIPTION OF THE DRAWINGS

Some embodiments of the disclosure may be understood by referring, in part, to the present disclosure and the accompanying drawings, wherein.

DETAILED DESCRIPTION

Figure 1:
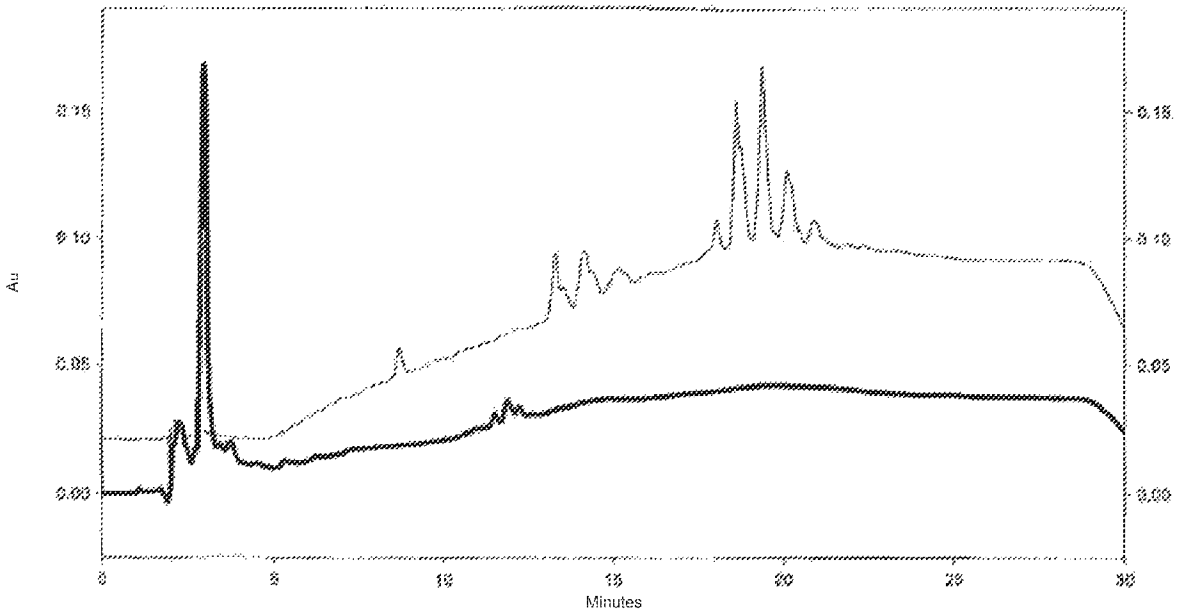
FIG. 1 illustrates HPLC chromatograms of a control and a test sample, according to a specific example embodiment of the disclosure.

The present disclosure relates, in some embodiments, to systems, compositions, methods, and apparatus for reducing emissions produced by a combustion engine. Metrics for performance may include, for example, fuel efficiency, fuel consumption, engine operating temperature, and the nature and quantity of emissions. Engine performance may also be assessed in terms of engine lifespan, frequency and/or nature of repairs needed, rough or smooth operation at idle and/or working conditions.

Incomplete combustion of engine fuel may lead to an unwanted loss in efficiency and/or cause exhaust gases to include one or more unwanted species. For example, engine exhaust (e.g., diesel engine exhaust) may include particulates, CO, and various nitrogen oxide ($NO_x$) species, each of which or all of which may be unwanted. Accordingly, it may be desirable to reduce, minimize, and/or prevent formation of these materials during combustion and/or release these materials into the surroundings. In some embodiments, it may be desirable to reduce, minimize, and/or prevent formation of these materials during combustion by modifying a fuel composition rather than a subject combustion engine.

Fuel systems, compositions, and/or methods of the disclosure may combust, in some embodiments, with lower emissions of total hydrocarbons (THC), non-methane hydrocarbons (NMHC), carbon monoxide (CO), carbon dioxide ($CO_2$), oxides of nitrogen ($NO_x$), particulate matter (PM), aldehydes, ketones, alcohols, ethers, volatile- and particulate-phase polycyclic aromatic hydrocarbons (PAH), nitrated polycyclic aromatic hydrocarbons (NPAH), and/or combinations thereof.

In some embodiments, a fuel composition including a fuel additive as disclosed herein may combust more completely than without a fuel additive. One metric of more complete combustion may be a reduction in the volume of fuel used, for example, to achieve the same work. A fuel composition including a fuel additive as disclosed herein may result in at least about 4% reduction in fuel use (e.g., 4%), at least about 8% reduction in fuel use (e.g., 8%), at least about 12% reduction in fuel use (e.g., 12%), at least about 16% reduction in fuel use (e.g., 16%), at least about 20% reduction in fuel use (e.g., 20%), and/or at least about 24% reduction in fuel use (e.g., 24%).

According to some embodiments, a fuel composition including a fuel additive as disclosed herein may include a reduced emission upon combustion in comparison to a corresponding fuel composition without such additive. For example, combusting a fuel composition including a fuel additive may produce an exhaust gas that may comprise from about 0% to about 35% of the sulfur dioxide produced by combusting the liquid fuel alone. Combusting a fuel composition including a fuel additive may produce an exhaust gas that may comprise less than about 30 ppm sulfur dioxide. For example, an exhaust gas may comprise substantially no sulfur dioxide.

In some embodiments, combusting a fuel composition including a fuel additive may produce an exhaust gas that may comprise a higher opacity when compared to a corresponding fuel composition not containing the fuel additive. Combusting a fuel composition including a fuel additive may produce an exhaust gas that may comprise an opacity of less than about 0.1%. For example, an exhaust gas produced from combusting a fuel composition including a fuel additive according to specific embodiments herein, may comprise an opacity of less than about 0.05%, or of less than about 0.02%. Combusting a fuel composition not including a fuel additive may produce an exhaust gas that may comprise an opacity of greater than about 10%, or of greater than about 15%.

A fuel composition including a fuel additive as disclosed herein may include a reduced emission upon combustion in comparison to a corresponding fuel composition without such additive. For example, combusting a fuel composition including a fuel additive may produce an exhaust gas that may comprise from about 10% to about 50% of the carbon monoxide produced by combusting the liquid fuel alone. Combusting a fuel composition including a fuel additive may produce an exhaust gas that may comprise less than about 120 ppm carbon monoxide. For example, an exhaust gas may comprise less than about 90 ppm carbon monoxide, or less than about 60 ppm carbon monoxide, or less than about 30 ppm carbon monoxide.

In some embodiments, a fuel composition comprising a fuel additive as disclosed herein may have reduced emissions upon combustion in comparison to a corresponding fuel composition without the additive. Combusting a fuel composition comprising a fuel additive may produce an exhaust gas having from about 2% to about 20% of the $NO_x$ produced by combusting a corresponding fuel without the fuel additive. For example, combusting a fuel composition comprising a fuel additive may produce an exhaust gas that may comprise from about 2% to about 10% of the $NO_x$ produced by combusting the liquid fuel alone, or from about 1% to about 5% of the $NO_x$ produced by combusting the liquid fuel alone. An exhaust produced by combusting a fuel composition comprising a fuel additive may comprise less than about 1200 ppm $NO_x$, or less than about 1050 ppm $NO_x$, or less than about 900 ppm $NO_x$.

A fuel composition including a fuel additive as disclosed herein may include reduced emissions upon combustion in comparison to a corresponding fuel composition without such additive. For example, combusting a fuel composition including a fuel additive may produce an exhaust gas having a temperature that is from about 65% to about 95% of a temperature produced by combusting the liquid fuel alone. Combusting a fuel composition including a fuel additive may produce an exhaust gas having a temperature of less than about 800° F., or of less than about 700° F., or of less than about 600° F. Combustion producing an exhaust gas of a lower temperature may desirably reduce thermal air pollution and may desirably reduce wear on combustion related parts.

In some embodiments, a combustion engine combusting a fuel composition including a fuel additive may desirably provide for a reduction in carbon deposits on the combustion engine parts (e.g., fuel injectors). For example, carbon deposits may be prevented and/or removed if pre-existing. Removal or prevention of carbon deposits may prolong engine part life.

Compositions

The present disclosure relates, in some embodiments, to a fuel additive for reducing emissions produced by a combustion engine. Major components of oils (e.g., vegetable oils) and fats (e.g., animal fats) include fatty acid triglycerides. When hydrolyzed and/or transesterified, fats (e.g., animal fats) and oils (e.g., vegetable oils) may yield glycerol, monoacyl glycerol, diacyl glycerol, free fatty acids, and/or fatty acid esters (e.g., fatty acid ethyl esters). According to some embodiments, a fuel additive may comprise one or more products of (partial or complete) hydrolysis of a fat (e.g., an animal fat) and/or oil (e.g., vegetable oil). In some embodiments, products of oil hydrolysis (POHs) may include one or more fatty acids (e.g., linoleic acid, oleic acid, palmitic acid, linolenic acid, and/or stearic acid), one or more fatty acid ethyl esters (e.g., linoleic acid ethyl ester, oleic acid ethyl ester, palmitic acid ethyl ester, linolenic acid ethyl ester, and/or stearic acid ethyl ester), one or more esters of a higher alcohol (e.g., linoleic acid ethyl ester, oleic acid ethyl ester, palmitic acid ethyl ester, linolenic acid ethyl ester, and/or stearic acid ethyl ester), one or more diacyl glycerols (e.g., in which the acyl groups are the same or different, arranged, 1, 2- or 1, 3-, and selected from linoleic acid, oleic acid, palmitic acid, linolenic acid, and/or stearic acid), and/or one or more monoacyl glycerols (e.g., linoleoylglycerol, oleoylglycerol, palmitoylglycerol, linolenoylglycerol, and/or stearoylglycerol). In some embodiments, a POH may further include a product of oil (partial or complete) oxidation. Accordingly, a fuel additive may comprise, in some embodiments, one or more fatty acids (e.g., linoleic acid, oleic acid, palmitic acid, linolenic acid, and/or stearic acid), one or more fatty acid ethyl esters (e.g., linoleic acid ethyl ester, oleic acid ethyl ester, palmitic acid ethyl ester, linolenic acid ethyl ester, and/or stearic acid ethyl ester), one or more esters of a higher alcohol (e.g., linoleic acid ethyl ester, oleic acid ethyl ester, palmitic acid ethyl ester, linolenic acid ethyl ester, and/or stearic acid ethyl ester), one or more diacyl glycerols (e.g., in which the acyl groups are the same or different, arranged, 1, 2- or 1, 3-, and selected from linoleic acid, oleic acid, palmitic acid, linolenic acid, and/or stearic acid), and/or one or more monoacyl glycerols (e.g., linoleoylglycerol, oleoylglycerol, palmitoylglycerol, linolenoylglycerol, and/or stearoylglycerol).

An additive may include one or more products of transesterification of an animal fat and/or vegetable oil, according to some embodiments. Upon contact with an alcohol (e.g., ethanol), fatty acids are released from the glycerol radical, react with the alcohol, and may form fatty acid esters. In some embodiments, a composition may comprise a product of a modified transesterification (e.g., a partial transesterification) of a triacyl glycerol (TAG). According to some embodiments, an additive comprising an ethyl ester (e.g., fatty acid ethyl ester) may provide desirable physical and chemical properties in comparison to a corresponding additive having a methyl ester (e.g., fatty acid methyl ester). For example, an additive including an ethyl ester may provide desirable miscibility with a liquid fuel across a range of temperatures, wherein the desirable miscibility may decrease viscosity. An additive including an ethyl ester may provide for an increased temperature stability in comparison to a corresponding additive having a methyl ester. Miscibility and stability benefits may increase as the ester length increases from ethyl to propyl or butyl. In some embodiments, an additive comprising a methyl ester may be weakly miscible in a liquid fuel, in comparison to a corresponding additive including an ethyl ester.

In some embodiments, a fuel additive may comprise a compound according to Formula I: $R_1$-$R_2$ (I), wherein: $R_1$ may be selected from the group consisting of HO, EtO, PrO, BuO, i-PrO, and t-BuO. $R_2$ may be selected from the group consisting of (C═O)$R_3$, $C_{1-18}$ alkyl, $C_{1-6}$ alkyl alcohol, $C_{2-18}$ monounsaturated alkyl, and $C_{4-18}$ polyunsaturated alkyl. $R_3$ may be selected from the group consisting of $C_{1-18}$ alkyl, $C_{1-6}$ alkyl alcohol, $C_{2-18}$ monounsaturated alkyl, and $C_{4-18}$ polyunsaturated alkyl. Each stereoisomer may be selected from the group consisting of E, Z, R, S, and a combination thereof. In some embodiments, combusting an enriched combustible fuel, or a fuel including a fuel additive, may produce an exhaust gas comprising from about 2% to about 98% of the $NO_x$ produced by combusting the liquid fuel alone.

According to some embodiments, a fuel composition or enriched combustible fuel composition may comprise a fuel additive at a concentration of about 7% (w/v) (e.g., 7% (w/v)), about 14% (w/v) (e.g., 14% (w/v)), about 21% (w/v) (e.g., 21% (w/v)), and/or about 28% (w/v) (e.g., 28% (w/v)), by volume of the fuel composition or enriched combustible fuel composition. A fuel composition may comprise, in some embodiments, a fuel additive at a concentration of about 0.5% to about 3%, about 1% to about 5%, about 4% to about 10%, about 8% to about 15%, about 10% to about 18%, about 15% to about 23%, about 17% to about 25%, about 20% to about 30%, about 24% to about 32%, and/or about 25% to about 35%, in each case (w/v), by volume of the fuel composition.

A liquid fuel may comprise any desired liquid fuel including, for example, any aliphatic hydrocarbon (e.g., methane, ethane, propane, butane, pentane, hexane, heptane, octane, nonane, decane), gasoline, kerosene, jet fuel, diesel, compressed natural gas, a butanol, biodiesel, soybean oil, aviation turbine fuel, glycerol trioleate, Avtur, Propellant-4, Jet Propellant-5, Jet Propellant-7, Jet Propellant-8, and/or hydroperoxides of unsaturated fatty acids, fatty acid ethyl esters, and combinations thereof. A fuel composition, for example, may comprise soybean oil, glycerol trioleate, and/or hydroperoxides of unsaturated fatty acids. A fuel composition, for example, may comprise fatty acid ethyl esters and ethanol. In some embodiments, a fuel composition may comprise a jet fuel and an additive. Jet fuel may comprise any desired mixture of hydrocarbons, petroleum spirits, and/or other compounds suitable for aircraft, including, for example, fuels identified as Jet A, Jet A-1, Jet A-2, Jet A-3, Jet A-4, Jet A-5, Jet A-6, Jet A-7, Jet A-8, and/or Jet B.

A combustible fuel composition, fuel composition, or enriched fuel composition may comprise a liquid fuel at a concentration from about 65% (w/v) (e.g., 65% (w/v)) to about 95% (w/v) (e.g., 95% (w/v)), by volume of the fuel composition. For example, a fuel composition may comprise about 5% (w/v) (e.g., 5% (w/v)), about 15% (w/v) (e.g., 15% (w/v)), about 25% (w/v) (e.g., 25% (w/v)), about 35% (w/v) (e.g., 35% (w/v), 45% (w/v) (e.g., 45% (w/v)), about 55% (w/v) (e.g., 55% (w/v)), about 65% (w/v) (e.g., 65% (w/v)), about 75% (w/v) (e.g., 75% (w/v), 85% (w/v) (e.g., 85% (w/v)), and/or about 95% (w/v) (e.g., 95% (w/v)), by volume of the fuel composition.

Methods

The present disclosure relates, in some embodiments, to operating a combustion engine. A method may comprise, for example, contacting each combustion engine chamber with a combustible fuel composition, the combustible fuel composition comprising a liquid fuel (e.g., aliphatic hydrocarbons, gasoline, jet fuel, diesel, and/or biodiesel) and an additive. Operating a combustion engine with a combustible fuel composition comprising a fuel additive may operate with an increased performance and/or reduced emissions profile in comparison to operating the combustion engine with a corresponding fuel composition without the fuel additive. For example, including a fuel additive may increase horse power, increase engine efficiency, reduce exhaust gas emissions, reduce engine temperature, reduce exhaust gas temperature, reduce exhaust gas opacity, and reduce fuel consumption.

A method of reducing a NOx produced by combusting a combustible fuel composition in a combustion engine or reducing the NOx produced by combusting the combustible fuel composition may comprise igniting, burning, or combusting the combustible fuel composition to produce an exhaust gas. A method may include venting a portion of an exhaust gas. In some embodiments, combusting a combustible fuel comprising an additive may produce an exhaust gas that may include, at an exhaust port up, from about 2% to about 98% of the $NO_x$ in a reference exhaust gas produced by combusting the same combustible fuel composition that lacks the additive.

A method for reducing a NOx produced by combusting a liquid fuel may comprise combining the liquid fuel and an additive, forming an enriched combustible fuel composition, wherein combusting the enriched combustible fuel may produce an exhaust gas comprising from about 2% to about 98% of the $NO_x$ produced by combusting the liquid fuel alone. An additive may comprise a compound according to Formula I $R_1$-$R_2$, wherein $R_1$ may be selected from the group consisting of HO, EtO, PrO, BuO, i-PrO, and t-BuO; $R_2$ may be selected from the group consisting of (C=O)$R_3$, $C_{1-18}$ alkyl, $C_{1-6}$ alkyl alcohol, $C_{2-18}$ monounsaturated alkyl, and $C_{4-18}$ polyunsaturated alkyl. $R_3$ may be selected from the group consisting of $C_{1-18}$ alkyl, $C_{1-6}$ alkyl alcohol, $C_{2-18}$ monounsaturated alkyl, and $C_{4-18}$ polyunsaturated alkyl, wherein each stereoisomer may be selected from the group consisting of E, Z, R, and S.

According to some embodiments, combusting, igniting, and/or burning a combustible fuel having an additive as disclosed herein may reduce the volume of fuel used, for example, to achieve the same work as combusting a fuel without the additive. Including an additive in a fuel to increase the performance profile of a combustion engine combusting the fuel may result in at least about 4% reduction in fuel use (e.g., 4%), at least about 8% reduction in fuel use (e.g., 8%), at least about 12% reduction in fuel use (e.g., 12%), at least about 16% reduction in fuel use (e.g., 16%), at least about 20% reduction in fuel use (e.g., 20%), and/or at least about 24% reduction in fuel use (e.g., 24%).

Combusting, igniting, and/or burning a combustible fuel having an additive as disclosed herein may reduce a concentration of sulfur dioxide in an exhaust gas produced by combusting, igniting, and/or burning the combustible fuel having the additive. For example, a method for reducing the emissions made by combusting a combustible fuel by including an additive herein may produce an exhaust gas that may comprise from about 0% to about 35% of the sulfur dioxide produced by combusting the liquid fuel alone. Combusting a fuel composition including a fuel additive may produce an exhaust gas that may comprise less than about 30 ppm sulfur dioxide. For example, an exhaust gas may comprise substantially no sulfur dioxide.

In some embodiments, reducing emissions produced by combusting a fuel by including an additive in the fuel may include reducing the opacity of an exhaust gas produced by combusting the fuel. A fuel additive may additionally reduce emissions produced by combusting a fuel in a combustion engine by including the additive by reducing the opacity of the fuel of an exhaust gas produced by combusting the fuel. For example, an exhaust gas produced from combusting a fuel composition including a fuel additive according to specific embodiments herein, may comprise an opacity of less than about 0.05%, or of less than about 0.02%. Combusting a fuel composition not including a fuel additive may produce an exhaust gas that may comprise an opacity of greater than about 10%, or of greater than about 15%.

In some embodiments, an exhaust gas at the exit port of a combustion engine combusting a fuel including an additive may have a reduced concentration of carbon monoxide in comparison to a corresponding combustion engine combusting a fuel not including the additive. For example, combusting a fuel composition including a fuel additive may produce an exhaust gas that may comprise from about 10% to about 50% of the carbon monoxide produced by combusting the liquid fuel alone. Combusting a fuel composition including a fuel additive may produce an exhaust gas that may comprise less than about 120 ppm carbon monoxide. For example, an exhaust gas may comprise less than about 90 ppm carbon monoxide, or less than about 60 ppm carbon monoxide, or less than about 30 ppm carbon monoxide. Including a fuel additive as disclosed herein may produce an exhaust gas that may comprise from about 2% to about 20% of the $NO_x$ produced by combusting a corresponding fuel without the fuel additive. For example, combusting a fuel composition comprising a fuel additive and a liquid fuel may produce an exhaust gas that may comprise from about 2% to about 10% of the $NO_x$ produced by combusting the liquid fuel alone, or from about 1% to about 5% of the $NO_x$ produced by combusting the liquid fuel alone, or up to about 2% of the $NO_x$ produced by combusting the liquid fuel alone. An exhaust produced by combusting a fuel composition comprising a fuel additive may comprise less than about 1200 ppm $NO_x$, or less than about 1050 ppm $NO_x$, or less than about 900 ppm $NO_x$. According to some embodiments, an exhaust gas at the exit port may include ≤98% of the $NO_x$ (e.g., NO, $NO_2$) in a reference exhaust gas produced by combusting the same combustible fuel composition that lacks the additive. For example, an exhaust gas at the exit port may include ≤96%, ≤94%, ≤92%, ≤90%, ≤88%, ≤86%, and/or ≤84%, of the NO in a reference exhaust gas produced by combusting the same combustible fuel composition that lacks an additive according to the present disclosure.

The operating temperature of an engine burning a combustible fuel having an additive as disclosed in some embodiments herein may be lower than an engine burning a fuel without an additive as disclosed. For example, igniting and/or burning a combustible fuel having an additive as disclosed in some embodiments herein may occur at a lower temperature (as assessed, for example, by the exhaust gas temperature and/or coolant temperature) than a combustible fuel without such additive. Exhaust temperature and/or coolant temperature may be reduced by up to about 2% (e.g., 2%), by up to about 4% (e.g., 4%), by up to about 6% (e.g., 6%), by up to about 8% (e.g., 8%), by up to about 10% (e.g., 10%), by up to about 12% (e.g., 12%), by up to about 14% (e.g., 14%), by up to about 16% (e.g., 16%), and/or by more than about 16% (e.g., 16%) compared to combustion of the same fuel without an additive as disclosed. For example, combusting a fuel composition including a fuel additive may produce an exhaust gas having a temperature that is from about 65% to about 95% of a temperature produced by combusting the liquid fuel alone. Combusting a fuel composition including a fuel additive may produce an exhaust gas having a temperature of less than about 800° F., or of less than about 700° F., or of less than about 600° F. Combustion producing an exhaust gas of a lower temperature may desirably reduce thermal air pollution and may desirably reduce wear on combustion related parts.

The present disclosure relates to methods for formulating a combustible fuel in some embodiments. A method may comprise, for example, contacting a liquid fuel (e.g., aliphatic hydrocarbons, gasoline, kerosene, jet fuel, diesel, and/or biodiesel) with an additive (e.g., one or more POHs). According to some embodiments, formulating a combustible fuel may require few or no additional measures to arrive at a desirable formulation. For example, mixing may be optional and/or predissolution may be unnecessary.

As will be understood by those skilled in the art who have the benefit of the instant disclosure, other equivalent or alternative compositions, devices, methods, and systems for reducing emissions produced by combusting a liquid fuel in a combustion engine can be envisioned without departing from the description contained herein. Accordingly, the manner of carrying out the disclosure as shown and described is to be construed as illustrative only.

Persons skilled in the art may make various changes in the kind, number, and/or concentration of additives without departing from the scope of the instant disclosure. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a composition, device, and/or system of the disclosure. Elements, compositions, devices, systems, methods, and method steps not recited may be included or excluded as desired or required.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/− about 10%, depicted value +/− about 50%, depicted value +/− about 100%) and/or a range endpoint. With respect to the former, a value of 50 depicted in an example, table, and/or drawing may form the basis of a range of, for example, about 45 to about 55, about 25 to about 100, and/or about 0 to about 100. Disclosed percentages are weight percentages except where indicated otherwise.

All or a portion of a device and/or system for reducing an emission produced by combusting a liquid fuel in a combustion engine may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

EXAMPLES

Some specific example embodiments of the disclosure may be illustrated by one or more of the examples provided herein.

Example 1: Mass Spectrometry

The exact mass spectrometer was a KRATOS MS25 using electron impact (EI) mode. The EI source was heated to 200° C. and the electron energy was set to 28 eV. The sample was introduced by heated probe directly into the EI source. The sample was inserted into the probe tip and the probe with the sample was inserted through a vacuum lock into the EI source. Then the temperature of the probe tip was ramped to evaporate the sample into the source where EI ionization takes place. Poorly volatile or thermally labile samples do not survive this process well and often decompose before evaporating.

Electron impact mass spectral measurement of the neat biodiesel data showed what looked like decomposition mass spectra indicating that the sample was decomposing before it came off the probe. The sample didn't appear to contain volatile compounds that were thermally stable enough to evaporate from the probe intact. None of this data is included here.

Example 2: High Performance Liquid Chromatography

High performance liquid chromatography (HPLC) was performed using a Beckman model 126 pumping unit and a Beckman 166 UV detector. The column was a Higgins PHALANX; C18, 150 mm×4.6 mm, 5 μm, 100 Å with detection at 230 nm. Phase A was methanol and phase B was 56% isopropanol/44% hexane (v/v). The HPLC was set to run 100% phase A for 1 minute, ramp to 50% A/50% B over 15 minutes, hold at 50% A/50% B for 10 minutes, and ramp back to 100% phase A in 2 minutes.

The chromatogram of sample 1 (fuel with test additive, 1% v/v in acetonitrile) is shown by the heavy line in FIG. 1. The test additive in sample 1 comprised fatty acid esters. The chromatogram of sample 2 (commercial grape seed oil, 1% v/v in 56% iPrOH: 44% hexane) is shown by the thin line in FIG. 1.

The retention profile data are shown in Table 1, from which it can be seen that the combined area under the peaks eluting before 7 min is 93% of the total area, only 3% remains as DAG.

TABLE 1

| Retention Time | Area | Area Percent | |
|---|---|---|---|
| 1.083 | 22466 | 0.504 | 93% |
| 1.708 | 78900 | 1.770 | |
| 2.217 | 801016 | 17.969 | |
| 2.933 | 2345845 | 52.624 | |
| 3.417 | 219319 | 4.920 | |
| 3.708 | 447641 | 10.042 | |
| 4.500 | 149635 | 3.357 | |
| 5.308 | 50902 | 1.142 | |
| 5.525 | 13980 | 0.314 | |
| 6.258 | 13367 | 0.300 | |
| 11.533 | 95657 | 2.146 | 7% |
| 11.917 | 131383 | 2.947 | |
| 12.250 | 71648 | 1.607 | |
| 12.625 | 16006 | 0.359 | |
| Totals | 4457765 | 100.000 | |

Two groups of peaks are evident in the grape seed oil chromatogram in FIG. 1 (thin line): triacyl glycerols (TAG's) near 20 minutes and diacyl glycerols around 14 minutes. Fatty acid ethyl esters (FAEEs) and monoacyl glycerols (MAGs) should not generally be present in commercial oil samples and are not seen here. The results with grape seed oil show that the HPLC method and column used were able to separate compounds of these different groups.

From the thick line in FIG. 1, it appears that the test additive has no TAG, some DAG around 12 minutes, some small FAEE peaks, at least one large MAG peak at 2.9 min, and maybe some small early eluting free fatty acid peaks. The large peak at 2.9 min is unlikely to be a FAEE for 2 reasons. First, its retention time is much earlier than is indicated from the reference chromatograms for FAEEs. Second, it is 50% of the total peak area, i.e. 50% of the total sample. If that much FAEE was present in the neat sample, then it should have shown itself as an intact compound at relatively low probe temperature when the electron impact mass spectrum was measured on the MS25 in Example 1. However, there was no clear evidence of an intact, distinct compound evaporating off of the heated probe.

The large peak in the HPLC chromatogram is about 50% of the total peak area. If this were due to straight forward transesterfication of a triacylglcerol (TAG), peaks of ethyl esters (FAEES) of the other 2 fatty acids liberated in that reaction should be visible. Since glycerol probably contributes little to the UV/vis spectra, the FAEE peaks should be at least comparable in size to the MAG peak. This is not the case; the next largest peak is less than 20% of the total.

Figure 2:
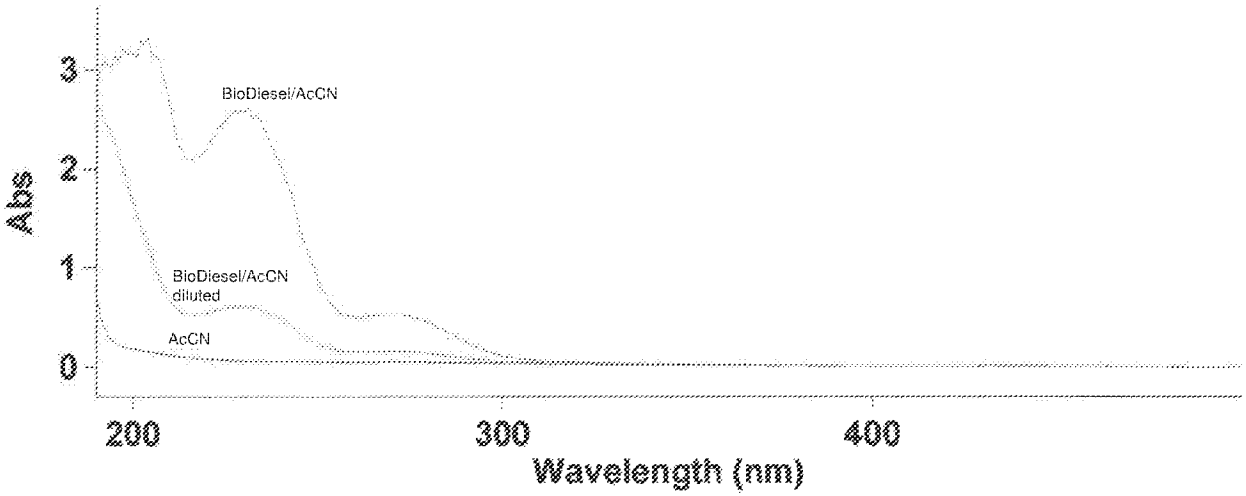
FIG. 2 illustrates UV-Vis spectra of a test sample according to a specific example embodiment of the disclosure.

The HPLC data was collected at 230 nm because this corresponded to a strong peak in the UV-vis spectra of a test additive (FIG. 2). Since hydroperoxides of unsaturated fatty acids may display absorbance at or near 230 nm, tested compositions may include one or more fatty acid oxidation products.

Example 3: Infrared Spectroscopy

Infrared spectroscopy was performed using an Agilent Cary 630 spectrometer equipped with a single pass diamond ATR (Attenuated Total Reflectance) accessory. Droplets of neat material were placed on the sample holder and directly analyzed.

Figure 3:
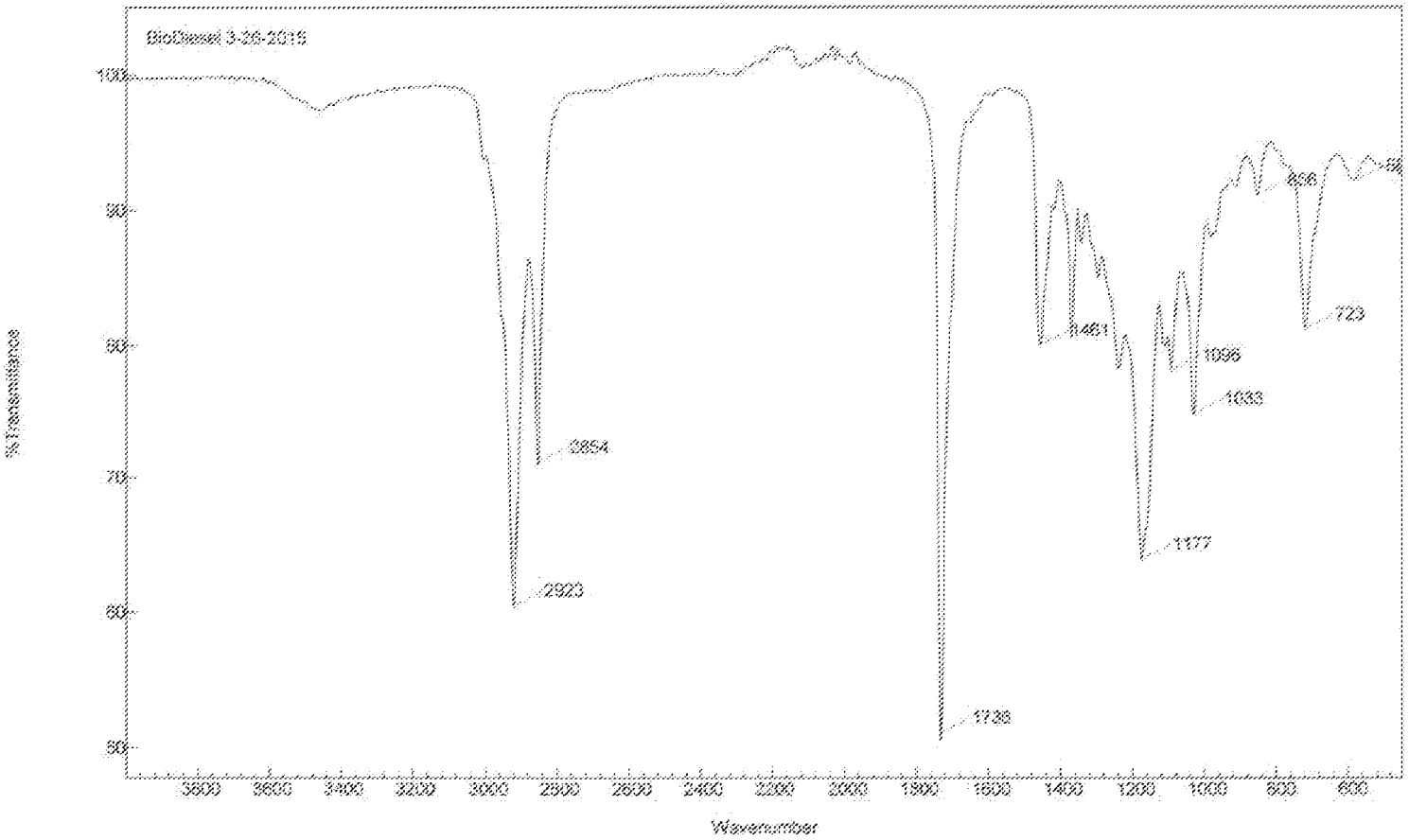
FIG. 3 illustrates an infrared spectrum of test sample according to a specific example embodiment of the disclosure.
Figure 4:
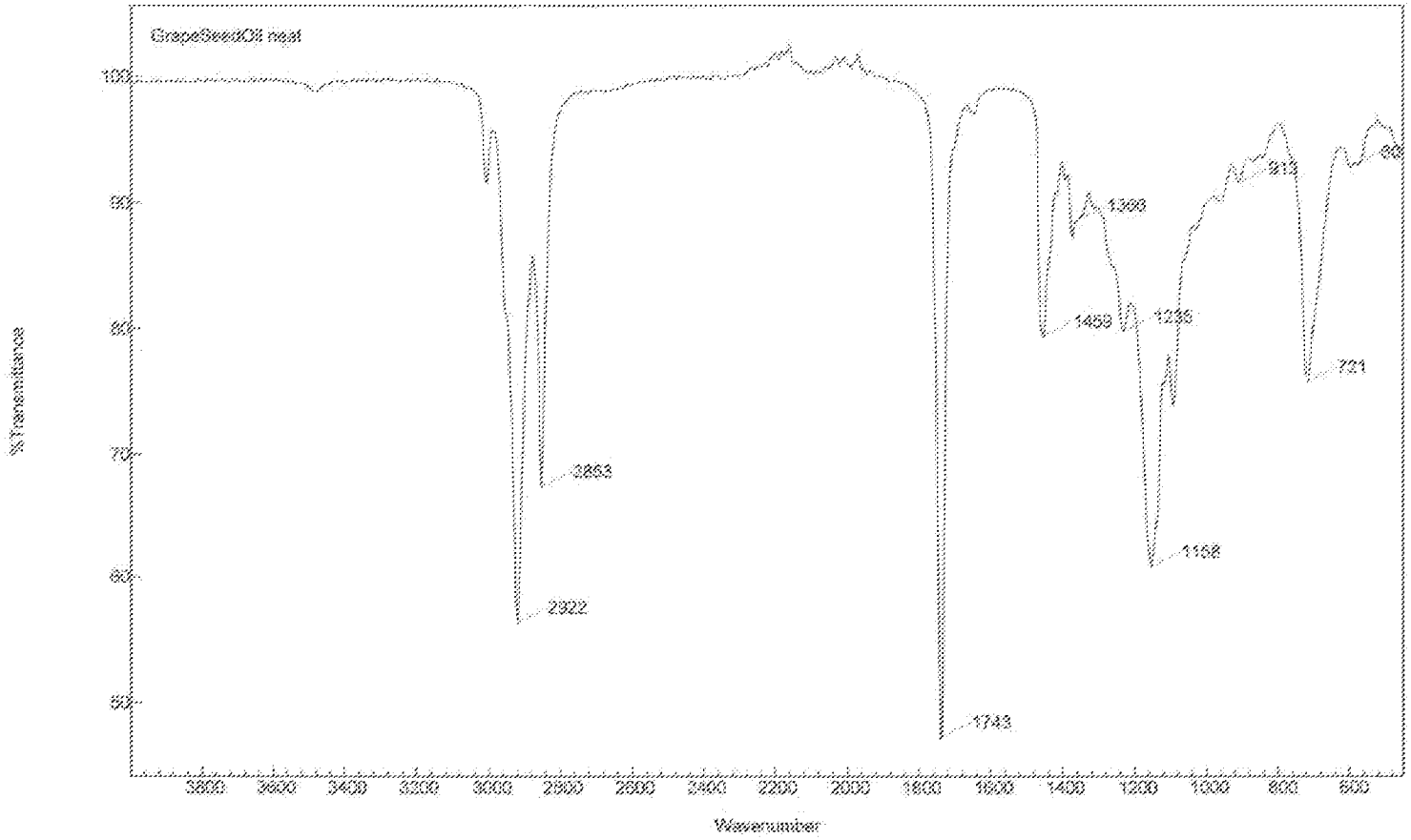
FIG. 4 illustrates an infrared spectrum of a control specimen.

The spectrum of sample 1 (fuel with test additive) is shown in FIG. 3 and the spectrum of sample 2 (commercial grape seed oil) is shown in FIG. 4. The appearance of certain peaks (e.g., 1736 and 1743) is consistent with the presence of products of oil hydrolysis.

What is claimed is:

1. A method for reducing a NOx produced by combusting a liquid fuel, the method comprising:

combining the liquid fuel and an additive to form an enriched combustible fuel composition, wherein the liquid fuel is selected from the group consisting of aliphatic hydrocarbons, gasoline, jet fuel, diesel, biodiesel, and combinations thereof, wherein the additive comprises at least one compound according to Formula I:

$$R_1\text{-}R_2 \quad (I)$$

wherein:

$R_1$ is selected from the group consisting of PrO and i-PrO;

$R_2$ is $C{=}O)R_3$; and $R_3$ is selected from the group consisting of $C_{17\text{-}18}$ alkyl, $C_{17\text{-}18}$ monounsaturated alkyl, and $C_{17\text{-}18}$ polyunsaturated alkyl, wherein each stereoisomer is selected from the group consisting of E, Z, R, S, and a combination thereof, wherein combusting the enriched combustible fuel produces an exhaust gas comprising from about 2% to about 98% of the NOx produced by combusting the liquid fuel alone, wherein the liquid fuel comprises at least one of a jet fuel, a diesel fuel, a gasoline, a naphtha, an ethanol, a coal tar, a liquefied petroleum gas, a compressed natural gas, and a butanol, and wherein the jet fuel comprises at least one of aviation turbine fuel, Jet A, Jet A-1, Jet A-2, Jet A-3, Jet A-4, Jet A-5, Jet A-6, Jet A-7, Jet A-8, Jet B, Jet Propellant-4, Jet Propellant-5, Jet Propellant-7, and Jet Propellant-8.

2. The method of claim 1, wherein the concentration of the additive is about 7% (w/v), by volume of the enriched combustible fuel.

3. The method of claim 1, wherein the concentration of the additive is about 14% (w/v), by volume of the enriched combustible fuel.

4. The method of claim 1, wherein the concentration of the additive is about 21% (w/v), by volume of the enriched combustible fuel.

5. The method of claim 1, wherein the concentration of the additive is about 28% (w/v), by volume of the enriched combustible fuel.

6. The method of claim 1, the exhaust gas comprising from about 2% to about 20% of the NOx produced by combusting the liquid fuel alone.

7. The method of claim 1, the exhaust gas further comprising from about 2% to about 10% of the NOx produced by combusting the liquid fuel alone.

8. The method of claim 1, the exhaust gas further comprising from about 2% to about 5% of the NOx produced by combusting the liquid fuel alone.

9. The method of claim 1, wherein the exhaust gas further comprises from about 10% to about 50% of the carbon monoxide produced by combusting the liquid fuel alone.

10. The method of claim 1, wherein the exhaust gas further comprises less than about 120 ppm of carbon monoxide.

11. The method of claim 1, wherein the exhaust gas further comprises less than about 60 ppm of carbon monoxide.

12. The method of claim 1, wherein the exhaust gas further comprises from about 0% to about 35% of the sulfur dioxide produced by combusting the liquid fuel alone.

13. The method of claim 1, wherein the exhaust gas further comprises less than about 30 ppm sulfur dioxide.

14. The method of claim 1, wherein the exhaust gas is substantially sulfur dioxide.

15. The method of claim 1, wherein the exhaust gas further comprises less than about 1050 ppm NOx.

16. The method of claim 1, wherein a temperature of the exhaust gas is less than about 700° F.

17. The method of claim 1, wherein a temperature of the exhaust gas is from about 85% to about 95% of a temperature produced by combusting the liquid fuel alone.

18. The method of claim 1, wherein an opacity of the exhaust gas is less than about 0.05%.

19. The method of claim 1, wherein an opacity of the exhaust gas is less than about 0.02%.

20. A method of reducing a NOx produced by combusting a combustible fuel composition in a combustion engine comprising at least one combustion chamber and at least one exhaust port, the method comprising:

(a) contacting each combustion engine chamber with the combustible fuel composition, the combustible fuel composition comprising:

(i) a liquid fuel selected from the group consisting of aliphatic hydrocarbons, gasoline, jet fuel, diesel, biodiesel, and combinations thereof; and (ii) an additive comprising at least one compound having a structure according to Formula I:

$$R_1\text{-}R_2 \quad (I)$$

wherein:

$R_1$ is selected from the group consisting of PrO and i-PrO;

$R_2$ is $(C{=}O)R_3$; and $R_3$ is selected from the group consisting of $C_{17\text{-}18}$ alkyl, $C_{17\text{-}18}$ monounsaturated alkyl, and $C_{17\text{-}18}$ polyunsaturated alkyl, wherein each stereoisomer is selected from the group consisting of E, Z, R, S, and a combination thereof, wherein the liquid fuel comprises at least one of a jet fuel, a diesel fuel, a gasoline, a naphtha, an ethanol, a coal tar, a liquefied petroleum gas, a compressed natural gas, and a butanol, and wherein the jet fuel comprises at least one of aviation turbine fuel, Jet A, Jet A-1, Jet A-2, Jet A-3, Jet A-4, Jet A-5, Jet A-6, Jet A-7, Jet A-8, Jet B, Jet Propellant-4, Jet Propellant-5, Jet Propellant-7, and Jet Propellant-8, (b) combusting the combustible fuel composition to produce an exhaust gas; and (c) venting at least a portion of the exhaust gas, wherein the exhaust gas includes at the exhaust port up from about 2% to about 98% of the NOx in a reference exhaust gas produced by combusting the same combustible fuel composition that lacks the additive.

21. The method of claim 20, wherein the concentration of the additive is about 7% (w/v), by volume of the enriched combustible fuel.

22. The method of claim 20, wherein the concentration of the additive is about 14% (w/v), by volume of the enriched combustible fuel.

23. The method of claim 20, wherein the concentration of the additive is about 21% (w/v), by volume of the enriched combustible fuel.

24. The method of claim 20, wherein the concentration of the additive is about 28% (w/v), by volume of the enriched combustible fuel.

25. The method of claim 20, the exhaust gas comprising from about 2% to about 20% of the NOx produced by combusting the liquid fuel alone.

26. The method of claim 1, the exhaust gas further comprising from about 2% to about 10% of the NOx produced by combusting the liquid fuel alone.

27. The method of claim 20, wherein the exhaust gas further comprising from about 2% to about 5% of the NOx produced by combusting the liquid fuel alone.

28. The method of claim 20, wherein the exhaust gas further comprises from about 10% to about 50% of the carbon monoxide produced by combusting the liquid fuel alone.

29. The method of claim 20, wherein the exhaust gas further comprises less than about 120 ppm of carbon monoxide.

30. The method of claim 20, wherein the exhaust gas further comprises less than about 60 ppm of carbon monoxide.

31. The method of claim 20, wherein the exhaust gas further comprises from about 0% to about 35% of the sulfur dioxide produced by combusting the liquid fuel alone.

32. The method of claim 20, wherein the exhaust gas further comprises less than about 30 ppm sulfur dioxide.

33. The method of claim 20, wherein the exhaust gas is substantially free of sulfur dioxide.

34. The method of claim 20, wherein the exhaust gas further comprises less than about 1050 ppm NOx.

35. The method of claim 20, wherein a temperature of the exhaust gas is less than about 700° F.

36. The method of claim 20, wherein a temperature of the exhaust gas is from about 85% to about 95% of a temperature produced by combusting the liquid fuel alone.

37. The method of claim 20, wherein an opacity of the exhaust gas is less than about 0.05%.

38. The method of claim 20, wherein an opacity of the exhaust gas is less than about 0.02%.

* * * * *